United States Patent [19]

Bauder

[11] 4,238,075

[45] Dec. 9, 1980

[54] FUEL INJECTION JET FOR INJECTION COMBUSTION ENGINES

[75] Inventor: Richard Bauder, Neckarsulm, Fed. Rep. of Germany

[73] Assignee: Audi NSU Auto Union Aktiengesellschaft, Fed. Rep. of Germany

[21] Appl. No.: 6,217

[22] Filed: Jan. 24, 1979

[30] Foreign Application Priority Data

Jan. 28, 1978 [DE] Fed. Rep. of Germany ..... 2803774

[51] Int. Cl.[3] ..... F02M 45/00

[52] U.S. Cl. ..... 239/533.4; 239/533.9

[58] Field of Search ..... 239/563, 533.2, 533.3, 239/533.4, 533.5, 533.6, 533.8, 533.9

[56] References Cited

U.S. PATENT DOCUMENTS

| | | | |
|---|---|---|---|
| 1,833,080 | 11/1931 | Kenworthy | 239/563 |
| 3,442,451 | 5/1969 | De Nagel | 239/533.5 X |
| 3,559,892 | 2/1971 | De Luca | 239/533.4 |

FOREIGN PATENT DOCUMENTS

| | | | |
|---|---|---|---|
| 2014215 | 10/1971 | Fed. Rep. of Germany | 239/533.3 |
| 2434339 | 1/1975 | Fed. Rep. of Germany | 239/533.4 |

*Primary Examiner*—Richard A. Schacher

*Attorney, Agent, or Firm*—Kane, Dalsimer, Kane, Sullivan and Kurucz

[57] ABSTRACT

A fuel injection jet for combustion engines has an injection head and a spring biased jet needle adapted to reciprocate towards and away from a conical needle valve seat provided by the injection head. Jet bores are provided in the injection head in at least two planes and are released in sequence upon reciprocation of the jet needle with increased fuel pressure. At least one jet bore emanates from the conical needle seat in order that it may be completely released even after slightest lifting of the jet needle to be fully admitted with fuel for atomization during injection. For the fuel supply exceeding the requirement beyond the idling and lower partial load range, the jet needle may be provided with a pin which is guided in a pocket bore of the injection head. This pocket bore is rearwardly of the needle seat and one or more jet bores adapted to be covered by the pin communicate therewith and are adapted to be closed when the pin is in the bore. With increased output requirements and consequently fuel pressure the bores covered by the pin are released. A channel network may be incorporated to interconnect the fuel supply channel and the jet bores.

9 Claims, 4 Drawing Figures

FUEL INJECTION JET FOR INJECTION COMBUSTION ENGINES

BACKGROUND OF THE INVENTION

The invention relates to a fuel injection jet of the type disclosed in German DE-OS 20 14 215. In this known fuel injection jet, a plurality of bores arranged in a common plane, emanate from a control ring channel, while bores in another plane emanate from a control pressure chamber. The jet needle which is lifted in accordance with the required output by the fuel pressure, forms a variable valve opening area with its control edge; and the control pressure chamber as well as the control ring channel with which the jet bores communicate are admitted with fuel.

The control pressure chamber and the control ring channel are intended to assure that the jet bores are fully exposed to the pressure of the fuel with the slightest release of the control edge of the jet needle. However, during operation of the combustion engine, the jet bores coupled with the control pressure chamber and control ring channel may be sucked empty due to the pressure fluctuations which occur during the operating cycle in the combustion chamber. Therefore, the additional sucked fuel from the volume of the control ring channel and the control pressure chamber into the combustion chamber of the combustion machine results in an undesirable increase in fuel consumption, and, in particular, to an increase of the polutants in the exhaust gas. Therefore, at each injection cycle, the jet needle must expose a large valve opening area instead of controlling the fuel quantity, so as to assure refilling of the control pressure chamber and the control ring channel, before injection occurs through the jet openings. Under these circumstances, control of the valve opening area by the jet needle cannot be assured due to the constant emptying and refilling of the control pressure chamber and the control ring channel which are connected with the jet bores. This is particularly pronounced at operation requiring low fuel dosages, such as during idling and in the lower load ranges. Since the jet bores are very large at the jet needle corresponding to the largest valve opening area, an insufficient atomization through the jet bores occurs, particularly in the idling position during low fuel supply, which results in insufficient fuel injection. Accordingly, there is a loss in the medium pressure, a high specific consumption, increased combustion rate and pure exhaust gas values.

SUMMARY OF THE INVENTION

It is therefore an object of the invention to provide a fuel injection jet which effectively eliminates the aforenoted disadvantages and which attains satisfactory fuel injection during idling and the lowest partial load requirements.

These and other objects are obtained by providing at least one jet bore emanating from the conical needle seat. As a result of this arrangement, the jet bore can be completely released even at the slightest lifting of the jet needle and can be fully admitted by the fuel, so that the fuel quantity which flows into the jet bore may be satisfactorily atomized during injection. Since this object of the invention eliminates the control pressure chamber of the prior art, no volume other than the jet bore is present from which the fuel residues may be sucked off, so that any increase in the fuel consumption and deterioration of the exhaust values are eliminated.

In order to obtain good injection of the fuel during idling and good atomization in the lower partial load range, the jet bore which emanates from the needle seat need only have a valve opening area which corresponds to the fuel requirement at idle running up to no more than 10 percent of full capacity.

For the fuel supply which exceeds the requirement beyond the idling and lower partial load range, the fuel injection jet may be defined by a jet needle provided with a cylindrical pin which is guided in the injection head in a pocket bore. This pocket bore is rearwardly of the needle seat from which one or a plurality of further jet bores emanate which are covered by the pin when the jet needle is closed.

With increased output requirements and therefore increased fuel pressure, the jet bores which are covered by the pin are additionally released, whereby the fuel quantity can be controlled in accordance with the dimension of the pin covering the jet bores. In contrast to the aforementioned embodiment of the prior art, no connection with a control ring channel is required, so that in this case, the fuel flows immediately into the jet bore and can be very well atomized. Furthermore, with this embodiment only the volume of the jet bores may be sucked empty which are relatively short, whereby no deterioration occurs in the exhaust value. The fuel injection jet may be so shaped for supplying the jet bores with fuel that (i) the jet needle is provided with a fuel supply channel which discharges into the pocket bore, and (ii) the needle seat is connected with the fuel supply channel by means of a channel. It is also possible that the bore could be connected by means of a channel with the fuel supply channel. The channel for supplying the additional jet bore may emanate from a position in front of the needle seat in the direction of flow of the fuel. The channel may also start from a position behind the needle seat in flow direction of the fuel and may be supplied with fuel when the jet needle is lifted from the needle seat.

In the fuel injection jet, the channel may be provided in the jet needle or in the jet head. The channel for supplying the jet bores with fuel may, for example, also be formed by a longitudinal groove which is located in the wall of the pocket wall opposite to the jet bores.

Embodiments of the invention will be explained in more detail in the following specification in conjunction with the accompanying drawings.

DETAILED DESCRIPTION

Figure 1:
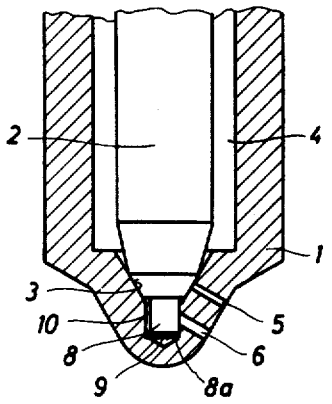
FIG. 1 is a fragmentary longitudinal sectional view through a fuel injection jet of a first embodiment of this invention.

FIG. 1 shows only the lower part of a fuel injection jet having an injection head 1 and a jet needle 2. The jet needle 2 is biased onto a conical needle seat 3 by means of a pressure spring (not shown). The needle 2 is adapted to be unseated by lifting inwardly and upwardly under pressure of fuel which is supplied to the jet needle through a fuel supply channel 4. The jet needle 2 is guided with a cylindrical pin 8 in the jet head 1 within a pocket bore 9 which is adjacent to the needle seat 3. In this embodiment, two jet bores 5 and 6 are arranged in two planes within jet head 1. The jet bore 5 which comprises a valve opening corresponding to the fuel requirement during idling extends from the conical needle seat 3. The jet bore 6 extends from the pocket bore 9 and is covered by pin 8 when the jet needle 2 is in a closed position. When the jet needle 2 is lifted the pocket bore 9 is connected by means of a channel or longitudinal groove 10 opposite the jet bore 6, with the fuel supply channel 4.

When the fuel is fed under pressure, the jet needle 2 is lifted from the needle seat 3 to a point where only the jet bore 5 is released. Under these circumstances complete opening of the jet bore 5 is obtained even at only the slightest stroke of jet needle 2. Thus, during the fuel injection from jet bore 5 a sufficient atomization occurs which is particularly advantageous with respect to idle running. In view of the small stroke a rapid closing and control of the injection process is obtained which eliminates a deterioration of the exhaust gas values. When the quantity and pressure of the fuel increases at the fuel injection jet, the jet needle 2 is lifted further. The pin 8 with its front edge 8*a* acting as the control edge, opens the second jet bore 6 an amount depending on the fuel pressure to permit access therethrough of the fuel requirement which is needed above idling. In this case the fuel flows from the fuel supply channel 4 through the needle seat and the longitudinal groove 10 into pocket bore 9, and, from there, into the jet bore 6. When the jet needle 2 is closed the residue volume which may be sucked off during the following operating cycle consists only of the quantity of fuel in jet bores 5 and 6, which after being released by the jet needle 2 can be immediately filled with fuel.

Figure 2:
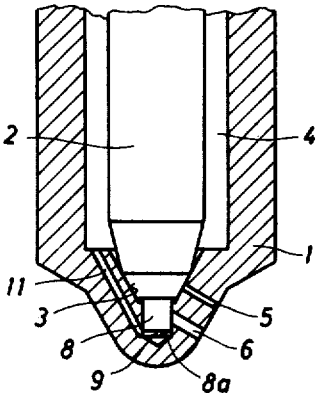
FIG. 2 is a similar longitudinal sectional view of a second embodiment.

Turning now to the embodiment shown in FIG. 2, wherein the same reference numerals are used for the same parts as in the embodiment of FIG. 1, the pocket bore 9 is in direct contact with the fuel supply channel 4. This communication is accomplished by means of a channel which is provided by a bore 11 positioned in the injection head. Otherwise, the function of this fuel jet injection jet is the same as in the embodiment of FIG. 1.

Figure 3:
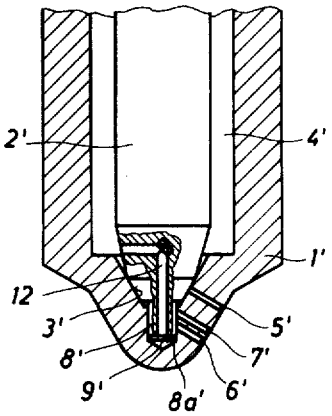
FIG. 3 is a similar sectional view of a third embodiment.

As can be seen in FIG. 3, wherein the same reference numerals are used for the same parts as in FIG. 1, the connection between the fuel supply channel 4' and the pocket bore 9' is provided by a channel 12 which is located in the jet needle 2'. Furthermore, three jet bores 5', 6' and 7' are mounted in three different planes, such that the fuel quantities fed through these bores are so separated that during idling the jet bore 5' is opened and when the fuel requirement is beyond the idling stage, the jet bore 6' is opened in addition to jet bore 7'. By separating the required fuel quantity which is needed above the idling stage in the form of two jet bores 6' and 7', a far better atomization is obtained during injection.

Figure 4:
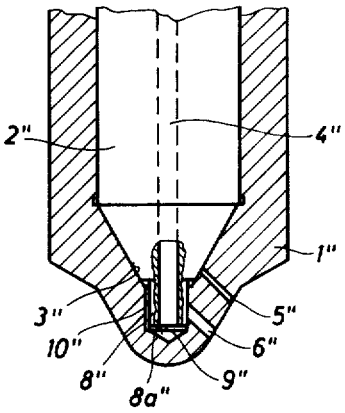
FIG. 4 is a similar sectional view of still a further embodiment.

The partial piece shown in FIG. 4 differs from the previous embodiments of fuel injection jet in that the jet needle 2'' is guided within the jet head 1, at least as shown, and that the fuel channel 4'' runs in the jet needle 2'' and discharges in pocket bore 9''. The introduction of fuel into the neddle seat 3'' is accomplished through longitudinal groove 10'' of the pocket bore 9''. In this embodiment the jet bore 5'' is released and thereafter the jet bore 6''.

Naturally, other embodiments will be apparent to those skilled in the art without departing from the spirit and framework of the invention. For example, the first released jet bore 5, 5' may have a valve opening area which exceeds the valve opening area required for an idling operation, so that through this jet bore the lower partial load requirement of fuel can be injected up to about 10 percent of the total load. Furthermore, the jet bores which are arranged in different planes may not be positioned exactly in a longitudinal direction with each other, but may be offset in circumferential direction with respect to each other, whereby different injection directions and a more favorable adjustment to the combustion chamber is provided. Furthermore, it is possible that from the planes of the jet bores not only one but a plurality of jet bores may emanate.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. A fuel injection jet for combustion engines having an injection head and a spring biased jet needle which lifts from a conical needle valve seat provided by the injection head due to fuel pressure acting against the spring bias, and wherein jet bores are provided in the injection head in at least two planes and are released in sequence upon reciprocation of the jet needle with increased fuel pressure, the improvement of at least one jet bore emanating from the conical needle seat, the jet needle being provided with a cylindrical pin which is guided in a pocket bore of the injection head from which at least one further jet bore emanates and which is covered by the pin when the jet needle is closed on the valve seat, and fuel supply channel means for communicating with the further jet bore when the jet needle is lifted a predetermined amount.

2. A fuel injection jet in accordance with claim 1, wherein the jet bore emanating from the needle seat has a valve opening area which corresponds to a fuel requirement at idle running up to no more than 10 percent of full capacity.

3. A fuel injection for combustion engines having an injection head and a spring biased jet needle which lifts from a conical needle valve seat provided by the injection head due to fuel pressure acting against the spring bias, and wherein jet bores are provided in the injection head in at least two planes and are released in sequence upon reciprocation of the jet needle with increased fuel pressure, the improvement of at least one jet bore emanating from the conical needle seat, the jet needle is provided with a cylindrical pin which is guided in a pocket bore of the injection head from which at least one further jet bore emanates and which is covered by the pin when the jet needle is closed on the valve seat, the jet needle being provided with a fuel supply channel which discharges into the pocket bore and the needle seat is connected with the fuel supply channel by means of a second channel.

4. A fuel injection jet for combustion engines having an injection head and a spring biased jet needle which lifts from a conical needle valve seat provided by the injection head due to fuel pressure acting against the spring bias, and wherein jet bores are provided in the injection head in at least two planes and are released in sequence upon reciprocation of the jet needle with increased fuel pressure, the improvement of at least one jet bore emanating from the conical needle seat, the jet needle is provided with a cylindrical pin which is guided in a pocket bore of the injection head from which at least one further jet bore emanates and which is covered by the pin when the jet needle is closed on the valve seat, the jet nozzle being surrounded by a fuel supply channel and the pocket bore is connected with the fuel supply channel by means of a second channel.

5. A fuel injection jet in accordance with claim 4, wherein the second channel emanates from a position in front of the needle seat in the flow direction of the fuel.

6. A fuel injection jet in accordance with claim 4, wherein the second channel emanates from a position behind the needle seat in the flow direction of the fuel and is admitted with fuel when the jet needle is lifted off its valve seat.

7. A fuel injection jet in accordance with claim 4, wherein the second channel is mounted in the jet needle.

8. A fuel injection jet in accordance with claim 4, wherein the second channel is within the injection head.

9. A fuel injection jet in accordance with claims 3 or 6, wherein the second channel is formed by a longitudinal groove which is located in the wall of the pocket bore at the side opposite of the further jet bore.

* * * * *

UNITED STATES PATENT AND TRADEMARK OFFICE

CERTIFICATE OF CORRECTION

PATENT NO. : 4,238,075
DATED : December 9, 1980
INVENTOR(S) : RICHARD BAUDER

It is certified that error appears in the above—identified patent and that said Letters Patent is hereby corrected as shown below:

Column 4, line 47, (claim 3) "fuel injection" should be --fuel injection jet--.

Signed and Sealed this

*Tenth* Day of *March 1981*

[SEAL]

*Attest:*

RENE D. TEGTMEYER

*Attesting Officer* *Acting Commissioner of Patents and Trademarks*